US012448086B1

(12) United States Patent
Echecopar Mongilardi

(10) Patent No.: US 12,448,086 B1
(45) Date of Patent: Oct. 21, 2025

(54) SURFING BOARD

(71) Applicant: Carlos Echecopar Mongilardi, Lima (DE)

(72) Inventor: Carlos Echecopar Mongilardi, Lima (DE)

( * ) Notice: Subject to any disclaimer, the term of this patent is extended or adjusted under 35 U.S.C. 154(b) by 592 days.

(21) Appl. No.: 17/889,551

(22) Filed: Aug. 17, 2022

(51) Int. Cl.
*B63B 32/50* (2020.01)
*B63B 32/40* (2020.01)
*B63B 32/57* (2020.01)

(52) U.S. Cl.
CPC ..... *B63B 32/50* (2020.02); *B63B 32/40* (2020.02); *B63B 32/57* (2020.02)

(58) Field of Classification Search
CPC ..... B63B 32/40; B63B 32/50; B63B 32/51; B63B 32/56; B63B 32/57
See application file for complete search history.

(56) References Cited

U.S. PATENT DOCUMENTS 6,036,560 A * 3/2000 Pekar ..... B63B 32/57 441/74
6,652,340 B2 * 11/2003 Mollin ..... B63B 32/57 441/74
7,029,349 B2 * 4/2006 Lin ..... B63B 32/57 441/74
7,377,828 B2 * 5/2008 Cheung ..... B32B 27/00 441/74
7,662,006 B2 * 2/2010 Mollis ..... B63B 32/51 441/74
7,892,058 B1 * 2/2011 Echecopar ..... B63B 32/57 441/74
8,932,094 B2 * 1/2015 Filen ..... B63B 32/40 441/74
10,124,866 B2 * 11/2018 Huarcaya-Pro ..... B63B 32/57
10,814,942 B1 * 10/2020 Cecola ..... B32B 21/14
2006/0116038 A1 * 6/2006 Cheung ..... B63B 32/57 441/65
2008/0210137 A1 * 9/2008 Cox ..... B63B 32/50 108/51.3
2009/0280704 A1 * 11/2009 Fort ..... B63B 32/40 441/74
2012/0196079 A1 * 8/2012 Brauers ..... B32B 3/04 428/116

* cited by examiner

*Primary Examiner* — Ajay Vasudeva
(74) *Attorney, Agent, or Firm* — Sanchelima & Associates, P.A.; Jesus Sanchelima; Christian Sanchelima

(57) ABSTRACT

An improved surfing board including a stringer assembly placed along the body of a surfboard assembly which includes a contracted vinyl lining assembly. The stringer assembly includes a pair of stringer members made of aluminum that are joined by a fiberglass and/or carbon fiber material at each bottom portion thereof defining an H-shaped body. The surfboard assembly includes a surfboard made of a foam material and has the stringer members along the inner thereof. The stringer assembly includes a curved configuration and a right configuration. The vinyl assembly includes a vinyl lining member and a bottom vinyl lining with a breathing valve which allows air to pass through a membrane towards an inner of the surfboard which allows thereof to slide on the water both layers joined by a protective vinyl film. The stringer members include shock absorbers which are placed on each distal end thereof to protect the surfboard.

9 Claims, 8 Drawing Sheets

SURFING BOARD

BACKGROUND OF THE INVENTION

1. Field of the Invention

The present invention relates to equipped surfing board and, more particularly, to a manufacturing process of soft surfboards, rescue boards and paddle boards that include an upgraded aluminum reinforcement in addition with a shock absorber placed on each distal end thereof also including a breathing valve above an improved board lining with a plurality of vinyl layers and an adjustment of stable fins/keels placed under the surfboards, rescue boards and paddle boards.

2. Description of the Related Art

Several designs for manufacturing processes of surfboards have been designed in the past. None of them, however, include a protection sheet in addition with a sealed edge protection with padded edges having below thereof an advanced fin system considering multi commercial fins/keels.

U.S. Pat. No. 7,892,058 issued to a surfing board and method for manufacture that include the cutting and bending of a buoyant material to a flat ach with a concave upper side and a convex underside to define an elongated body T-shaped longitudinal cutouts extend from one end to the other along the upper side and underside, respectively for a reinforced surfing board. However, it differs from the present invention because it includes a manufacturing process of soft surfboards, rescue boards and paddle boards that includes an upgraded aluminum reinforcement in addition with a shock absorber placed on each distal end thereof also including a breathing valve above an improved board lining with an adjustment of stable fins/keels placed under the surfboards, rescue boards and paddle boards reference.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide an improved aluminum core with a pair of T-shaped body arches which are bonded with fiberglass and resin.

It is another object of this invention to provide a shock absorber for the nose and tail of the surfboard made with an Ethylene Vinyl Acetate (EVA) or a variation thereof.

It is another object of the present invention to provide an upgraded vinyl lining with a breathing valve.

It is yet another object of this invention to provide such a device that is inexpensive to implement and maintain while retaining its effectiveness considering that the expanded PolyStyrene (EPS), vinyl and aluminum materials are easily recyclable.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
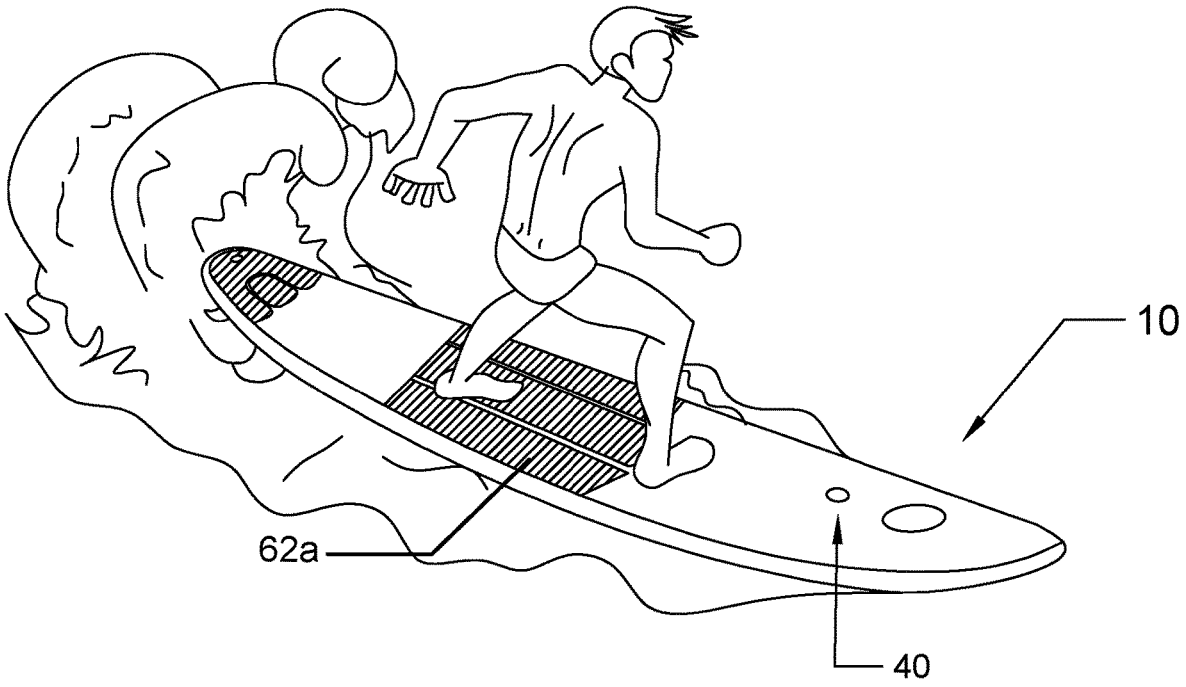
FIG. 1 represents an operational view of the present invention 10. A surfboard is shown 40 with a vinyl lining member 62*a*.

Referring now to the drawings, where the present invention is generally referred to with numeral 10, it can be observed that it basically includes a stringer assembly 20, a surfboard assembly 40 and a vinyl lining assembly 60. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Figure 3:
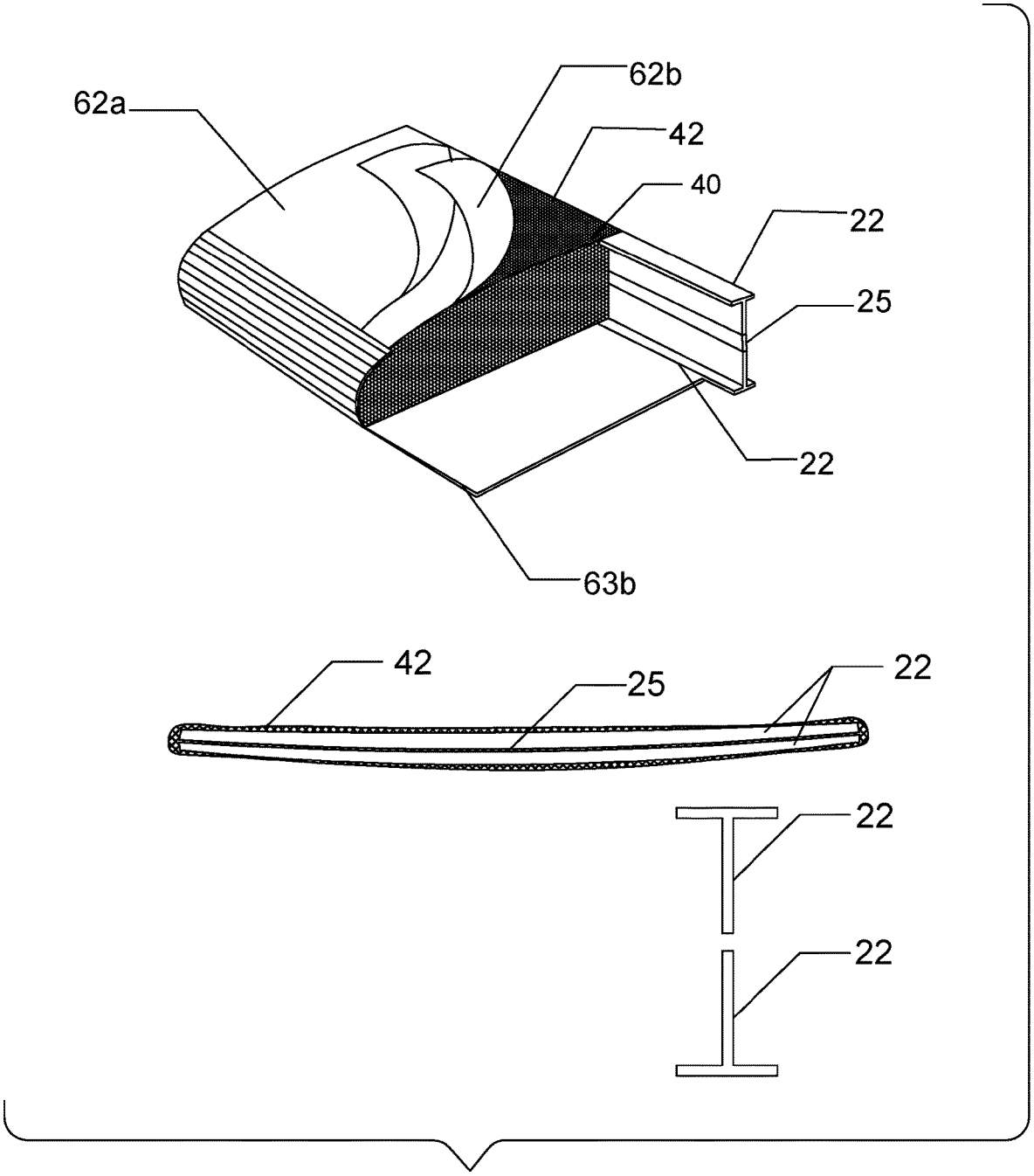
FIG. 3 illustrates an enlarged internal view of the stringer members 22 with a curve configuration. A connector 25 interlocks stringer members 22 along an inner of a surfboard 42.

The stringer assembly 20 includes stringer members 22, a connector 25, shock absorbers 26 and protective wrap 26*a*. In a preferred embodiment the stringer members 22 may be made of an aluminum material to allow the surfboard assembly 40 be light and suitable to carry. In other embodiments, it may be suitable for the core 22 to be made of a duralumin which allow the surfboard assembly 40 to have a lightweight body and considering a carbon fiber material which is a light and resistant material suitable for the stringer members 22 In one embodiment, the stringer members 22 may have a curved configuration in cooperation with the surfboard assembly 40 wherein the stringer members 22 may have a t-shaped body being placed in the opposite direction wherein each of the stringer members 22 are coplanar and may be interlocked by a connector 25 as shown in FIG. 3 defining a H-shaped curved body. In a preferred embodiment each of the stringer members 22 may have an elongated body which allows it to provide resistance to the surfboard assembly 40. The stringer members 22 with the curved configuration may be suitable to be related by a connector 25 which may be made of a fiberglass and/or carbon fiber, and it is to be considered that the connector 25 may also be complemented by a resin material to provide resistance and withstanding when using the surfboard assembly 40.

Figure 3A:
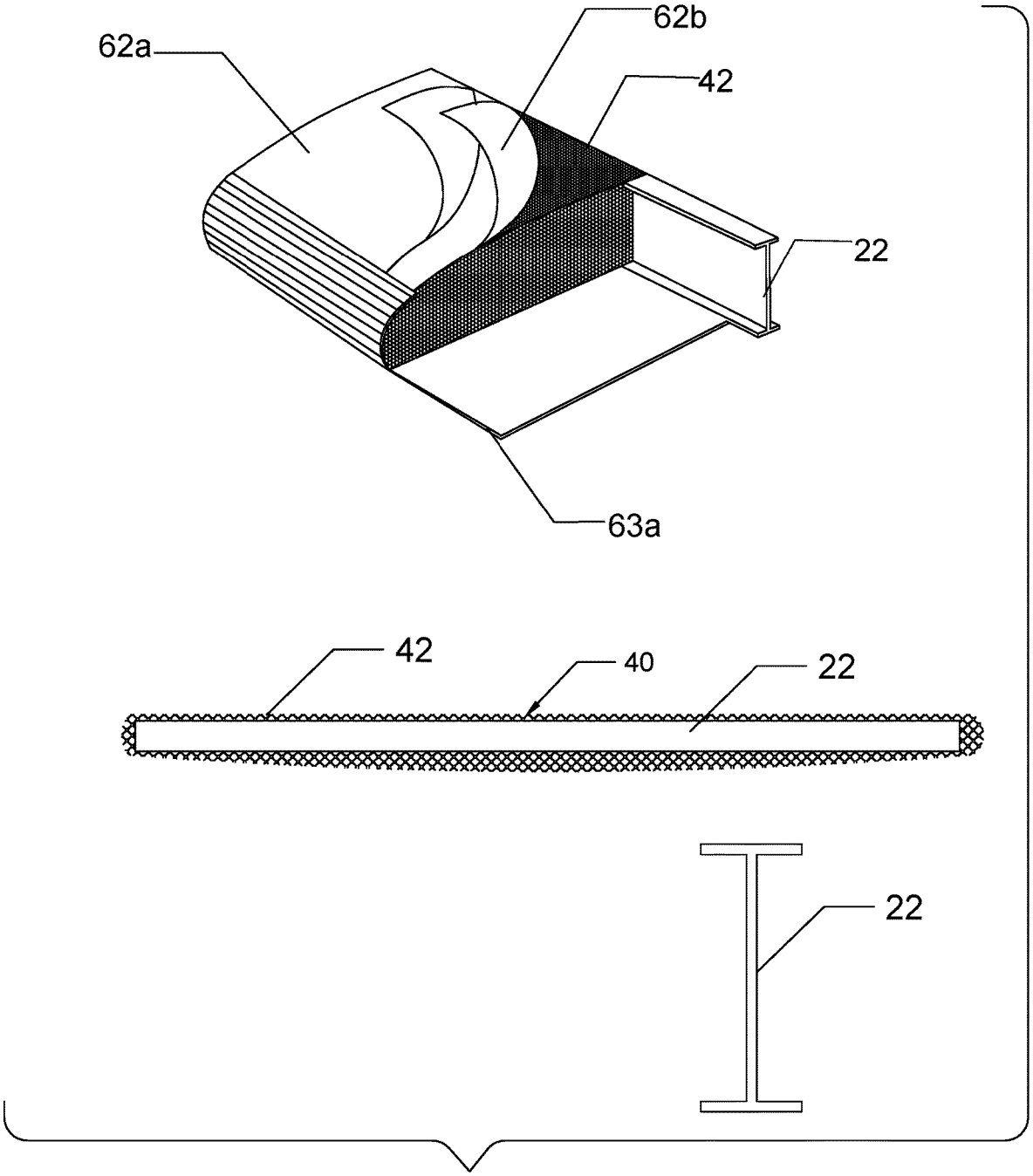
FIG. 3*a* illustrates an enlarged internal view of the stringer member 22 with a right configuration. Stringer member 22 extends along the inner of the surfboard 42.
Figure 4:
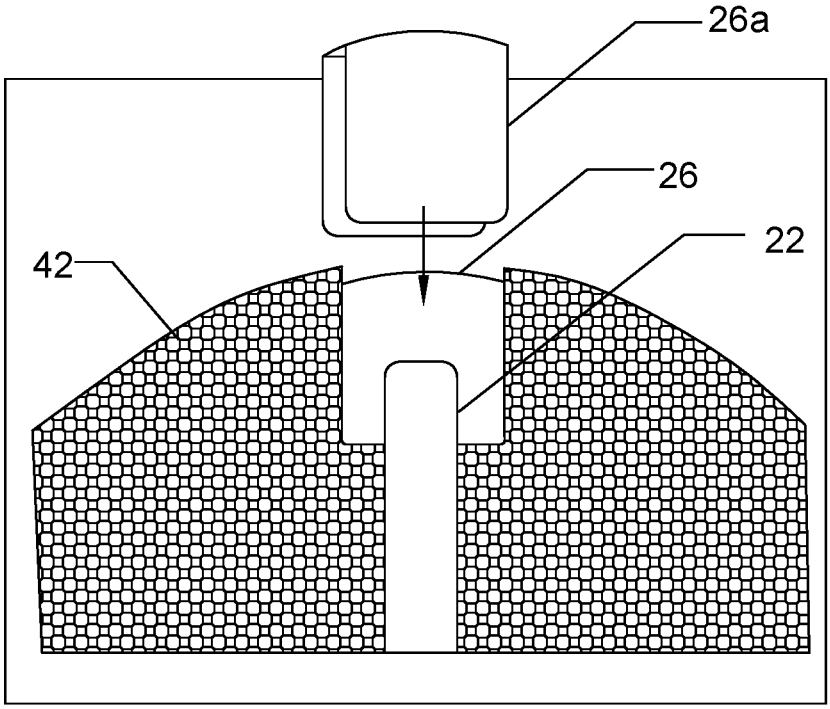
FIG. 4 shows an enlarged internal view of shock absorber 26 which is inserted in a distal end of one of the stringer members 22.
Figure 5:
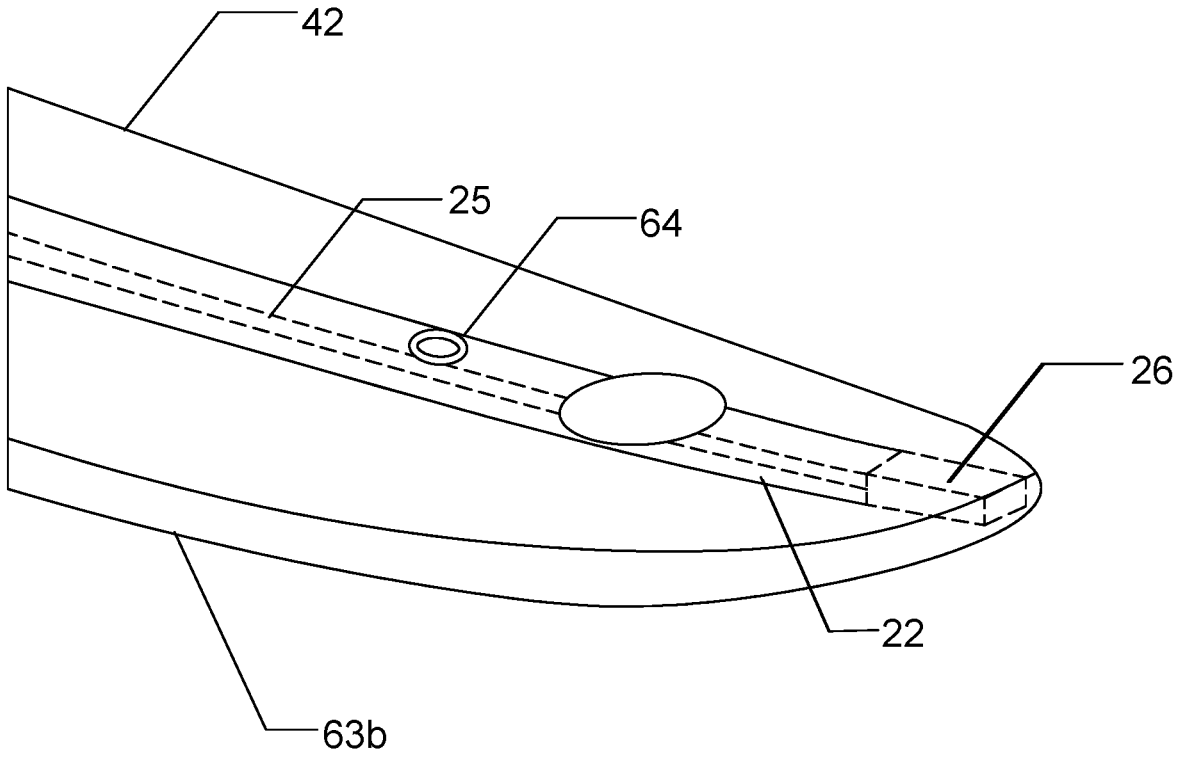
FIG. 5 is a representation of an enlarged internal view of the surfboard 42 wherein is shown one of the shock absorbers 26 inserted to a distal end of the stringer members 22 and placed in a distal end of the surfboard 42.

As best observed in FIG. 3 the connector 25 may have an elongated body that conforms with the shape of the bottom of each of the stingers 22, the elongated body conforms between each of the stingers 22 to connect both stringer members 22. The connector 25 may be configured to allow each of the stringer members 22 to stay stable along the curved configuration of the body of the surfboard assembly 40 wherein each of the stringer members 22 either are attached to a top inner surface or bottom inner surface thereof. In another embodiment one of the stringer members 22 may present a straight configuration wherein the stringer members 22 may have an H-shaped body which extends along the inner of the surfboard assembly 40 as best observed in FIG. 3*a*. The stringer member 22 extends from one distal end of the surfboard assembly 40 to another distal end thereof having a straight body.

In a preferred embodiment, the stringer assembly 20 may include shock absorbers 26 which are inserted in the endings of the stringer assembly 20 allowing the surfboard assembly 40 to withstand when dropping or also the resistance that the sea opposes with the waves to the surfboard assembly 40. The shock absorbers 26 may be made of an Ethylene-Vinyl Acetate (EVA) material or a variation thereof which gives protection to the distal ends of the surfboard assembly 40. In a suitable embodiment, each of the shock absorbers 26 may have a body that conforms with the distal ends of the stringer assembly 20. Each of the shock absorbers 26 may clamp the distal ends of each of the stringer members 22. It is to be considered that the shock absorbers 26 may protect the distal ends of the surfboard assembly 40 thereby preventing damage or breaking surfboard assembly 40. In a suitable embodiment, the protective wrap 26*a* may be configured to cover one of the shock absorbers 26 having a shape that conforms with the body of the shock absorbers 26 as shown in Figure. It is to be considered that the protective wrap 26*a* may be made of EVA or any other variation thereof suitable to provide a soft surface.

Figure 7:
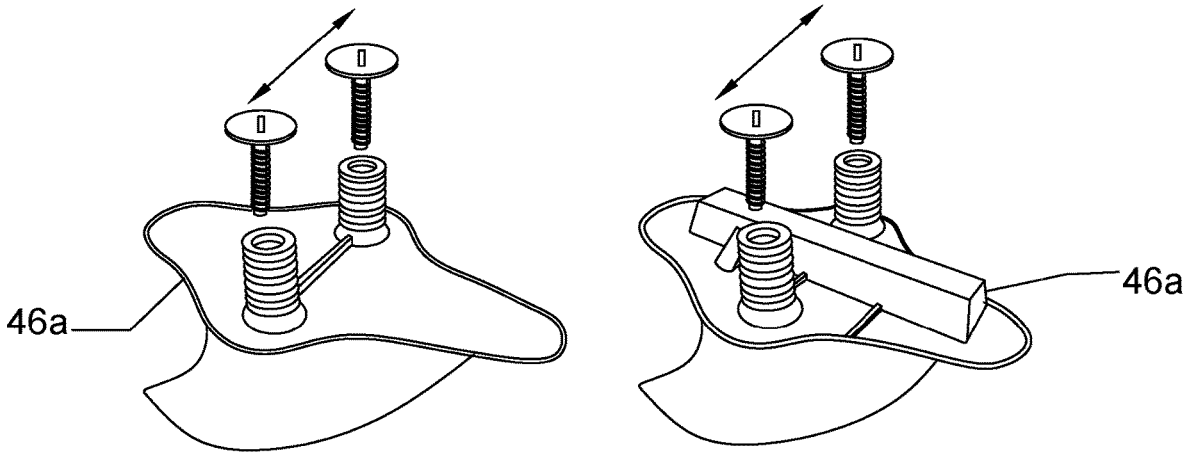
FIG. 7 is an isometric view of fins/keels 46*a* with a cross configuration.

The surfboard assembly 40 includes a surfboard 42, a nose 44*a*, a tail 44*b* and fins/keels 46*a*. The surfboard 42 in a preferred embodiment may be made of an Expanded Poly Styrene (EPS). EPS has suitable properties to provide durability and moisture resistance. The surfboard 42 may be configured to store the stringer assembly 20 along the inner thereof allowing the surfboard 42 to prevent breaking. In a suitable embodiment, the surfboard 42 may include the tail 44*b* and the nose 44*a* in each distal end thereof. The shock absorbers 26 also prevent the breaking or cracking of the surfboard 42. It is to be understood that the nose 44*a* and the tail 44*b* may have a curved shape. In a preferred embodiment the surfboard assembly 40 may be covered by the vinyl lining assembly 60 that provides an anti-slip surface. It is to be understood that the fins/keels 46*a* may be attached to the bottom of the surfboard 42. In a preferred embodiment, the fins/keels 46*a* may be configured to provide stability when using the surfboard 42 by a cross configuration wherein bolts/nuts are embedded in a transversal configuration instead of a regular longitudinal configuration as best shown in FIG. 7.

The vinyl lining assembly 60 includes a vinyl lining member 62*a*, internal vinyl layers 62*b*, a bottom vinyl lining 63*a*, a vinyl border 63*b*, a breathing valve 64 and a protection sheet 65. It may be considered that the vinyl lining member 62*a* may be placed on a top portion or surface of the surfboard 42 while the bottom vinyl lining 63*a* may be on a bottom portion of the surfboard 42. The internal vinyl layers 62*b* may be configured to be placed on both surfaces of the surfboard 42 wherein one of the internal vinyl layers 62*b* is adjacent to a top surface of the surfboard 42 while another of the internal vinyl layers 62*b* is placed along a bottom surface of the surfboard 42. The internal vinyl layers 62*b* may be suitable to be made of an anti-cut reinforcement material to provide resistance against stone cuts both of each configured as reinforcements for the vinyl lining member 62*a* and the bottom vinyl lining 63*a*. In a suitable embodiment, the vinyl lining member 62*a* may be configured to cover the surfboard 42 allowing a stable surface for the user when surfing as observed in FIG. 1. As best observed in FIG. 6*a* in a preferred embodiment the vinyl lining member 62*a* may be adjusted to the surfboard 42 and may be placed above one of the internal vinyl layers 62*b* which adjust adjacent to the surfboard 42. The vinyl lining member 62*a* may be made o surface of the surfboard 42 to prevent using wax over the surfboard 42. In one embodiment, the vinyl lining member 62*a*, the internal vinyl layers 62*b* and the bottom vinyl lining 63*a* may have a shape that conforms with the top and bottom surfaces of the surfboard 42.

Figure 6:
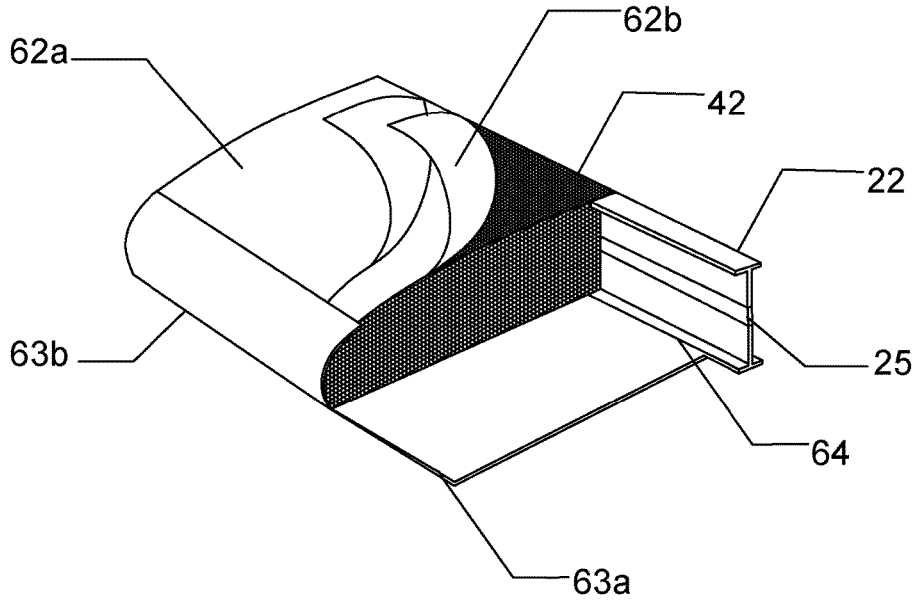
FIG. 6 shows an isometric view of a vinyl lining member 62*a* and a bottom vinyl lining 63*a* placed in a top surface and a bottom surface of the surfboard 42.
Figure 6A:
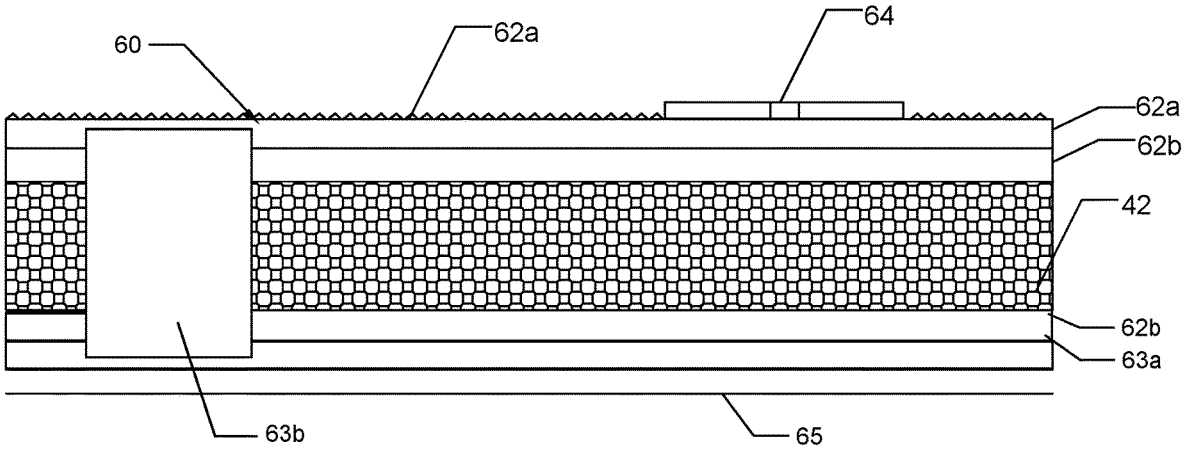
FIG. 6*a* illustrates a side sectional view of the vinyl lining member 62*a* and the bottom vinyl lining 63*a* mounted on internal vinyl layers 62*b*. A protection sheet 65 is placed under the bottom vinyl lining 63*a*.

As best observed in FIG. 6*a* the vinyl lining member 62*a* may entirely cover a top surface of the surfboard 42 considering a Poly Vinyl Chloride (PVC) material which adjusts elastically to the body of the surfboard 42 as a lamination configuration. In a preferred embodiment the vinyl lining member 62*a* may be configured in cooperation with a breathing valve 64 attached to a top surface of the surfboard 42 as shown in FIG. 6*a*. It is to be understood that the vinyl lining member 62*a* and the breathing valve 64 are configured to allow air to pass through instead of water ensuring that the surfboard 42 breathes to avoid adhering either the vinyl lining member 62*a* or the internal vinyl layers 62*b* to the surfboard 42. It may be considered that the vinyl lining member 62*a*, the bottom vinyl lining 63*a* and the internal vinyl layers 62*b* may be elastically adjusted to the surfboard 42. In a preferred embodiment the vinyl lining member 62*a* may be configured as a single laminated film together with one of the internal vinyl layers 62*b* wherein the vinyl lining member 62*a* has an anti-slip print which entirely cover a top surface of the surfboard 42 and may prevent a user's feet from slipping when surfing while the internal vinyl layer 62*a* may reinforce the vinyl lining member 62*a*.

Figure 2:
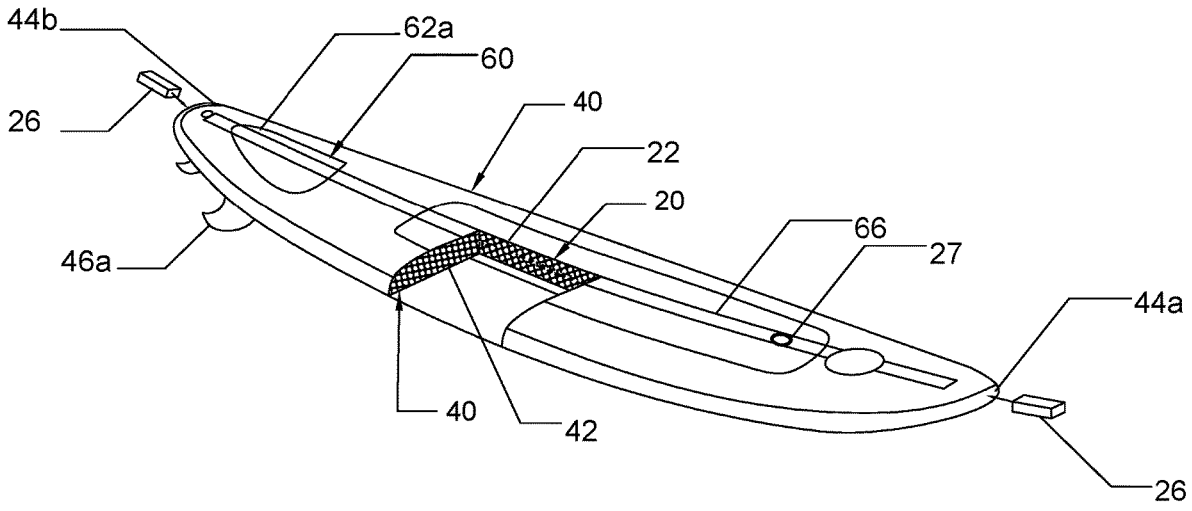
FIG. 2 shows an isometric internal view of a stringer assembly 20 wherein is shown the surfboard assembly 40 and a vinyl lining assembly 60.

As best observed in FIG. 6*a* the bottom vinyl lining 63*a* which may be made of a PVC material as vinyl lining member 62*a* may be placed on a bottom portion of the surfboard 42 being adjacent to one of the internal vinyl layers 62*a* placed under a bottom surface of the surfboard 42. In a preferred embodiment, the bottom vinyl lining 63*a* may be made of a slip resistant smooth vinyl material configured to be in constant contact with the water when surfing improving performance of the surfboard 42. It may be understood that the bottom vinyl lining 63*a* and the vinyl lining member 62*a* may be secured by the vinyl border 63*b* as shown in the FIG. 6, the vinyl border 63*b* may connect the bottom vinyl lining 63*a* and the vinyl lining member 62*a* wherein the vinyl border 63*b* partially cover a side portion of the surfboard 42. The vinyl border 63*b* may be suitable to be made of a PCV material. In one embodiment the vinyl border 63*b* may cover the lateral edges of the surfboard 42. It may be considered that the breathing valve 64 in a suitable embodiment may have a circular shape as best observed in FIG. 2 allowing the bottom vinyl lining 63*a* to breathe. The surfboard 42 may also be integrated with the protection sheet 65 to provide resistance against stone cuts, urchin corals or sharp pieces such as nails. It is to be considered that the protection sheet 65 may have a laminated configuration. In one embodiment, the protection sheet 65 may be integrated within a bottom portion of the EPS body of the surfboard 42 to resistance against cuts or impacts that surfboard 42 may receive. In a suitable embodiment, the bottom vinyl lining 63*a* may be configured as a single laminated film together with one of the internal vinyl layers 62*b* wherein the bottom vinyl layer 63*a* has a smooth surface allowing the surfboard 42 slide on the water while the internal vinyl layer 62*b* may reinforce the bottom vinyl layer 63*a*.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An improved surfing board, comprising:

a surfboard having a body made of expanded polystyrene (EPS);

a stringer assembly including stringer members, wherein at least one string member of the string members is internally placed along a central longitudinal axis of the surfboard, wherein said stringer members provide rigidity to said surfboard, wherein at least one of the stringer members comprises an elongated aluminum body having a T-shaped cross-sectional profile, and wherein at least another of the stringer members comprises an elongated aluminum body having an H-shaped cross-section comprising two spaced-apart parallel horizontal flanges connected by an intermediate vertical connector;

said stringer members each including shock absorbers inserted at distal ends thereof; said surfboard further includes a vinyl lining assembly comprising a vinyl lining member, a bottom vinyl lining connected by a vinyl border, and an integral breathing valve, wherein said vinyl lining assembly envelops the body of the surfboard, and wherein said breathing valve permits selective air flow to prevent internal pressure buildup and maintain the integrity of the vinyl lining assembly under elevated temperature conditions while blocking water entry.

2. The improved surfing board of claim 1 has a curved configuration in which the surfboard body is curved, and wherein the at least one of the stringer members comprise two elongated aluminum bodies each having the T-shaped cross-sectional profile, said aluminum bodies being arranged in mirror configuration with their respective T-flanges facing opposite directions and joined to each other by a deformable connector, whereby said connector undergoes deformation to enable the 2 stringer assembly to follow the surfboard curvature without deforming the individual aluminum bodies.

3. The improved surfing board of claim 1, wherein the surfboard has a straight configuration, and wherein the body of the surfboard is flat, and wherein the at least another of the stringer members comprising the elongated aluminum body having an H-shaped cross-section is disposed, along the central longitudinal axis of the surfboard.

4. The improved surfing board of claim 1, wherein said shock absorbers comprise a body made of ethylene-vinyl acetate (EVA) enclosed by a protecting wrap, and wherein said shock absorbers are positioned at distal ends of the 21 stringer members proximate to a nose and a tail of the surfboard.

5. The improved surfing board of claim 1, wherein said vinyl lining member is positioned over an internal vinyl layer placed on a top surface of said surfboard, and said bottom vinyl lining is positioned over an internal vinyl layer placed on a bottom surface of said surfboard.

6. The improved surfing board of claim 5, wherein said vinyl lining member comprises an anti-slip material and said bottom vinyl lining comprises a slip-resistant vinyl material.

7. The improved surfing board of claim 1, wherein said surfboard includes a protection sheet attached to a bottom surface thereof configured to resist against cuts or impacts.

8. The improved surfing board of claim 1, wherein said vinyl lining member is laminated with an internal vinyl layer positioned above the top surface of said surfboard, and said bottom vinyl lining is laminated with an internal vinyl layer positioned below the bottom surface of said surfboard.

9. An improved surfing board, comprising:

a surfboard having a body made of expanded polystyrene (EPS), said surfboard includes fins disposed on a bottom surface thereof and configured in a cross arrangement with transversely oriented fasteners for stability;

a stringer assembly including stringer members internally placed along a central longitudinal axis of the surfboard, wherein said stringer members provide rigidity to said surfboard and comprise:

in a curved configuration: two elongated aluminum bodies each having a T-shaped cross-sectional profile arranged in mirror configuration with their respective T-flanges facing opposite directions and joined by a deformable connector, whereby said connector enables the stringer assembly to follow the surfboard curvature without deforming the individual aluminum bodies;

in a straight configuration: an elongated aluminum body having an H-shaped cross-section comprising two spaced-apart parallel horizontal flanges connected by an intermediate vertical connector;

said stringer members include shock absorbers that comprise a body made of ethylene-vinyl acetate (EVA) enclosed by a protecting wrap, and wherein said shock absorbers are positioned at distal ends of the stringer members proximate to a nose and a tail of the surfboard;

said surfboard includes a vinyl lining assembly comprising a vinyl lining member, a bottom vinyl lining connected by a vinyl border, and an integral breathing valve, wherein said vinyl lining assembly envelops the body of the surfboard, and wherein said breathing valve permits selective air flow to prevent internal pressure buildup conditions while the integrity of the vinyl lining assembly under elevated 21 temperature conditions, while blocking water 22 entry;

wherein said vinyl lining member is positioned over an internal vinyl layer placed on a top surface of said surfboard, and said bottom vinyl lining is positioned over an internal vinyl layer placed on a bottom surface of said surfboard; wherein said vinyl lining member comprises an anti-slip material and said bottom vinyl lining comprises a slip-resistant vinyl material.

* * * * *